US008607386B2

(12) United States Patent
Daly et al.

(10) Patent No.: US 8,607,386 B2
(45) Date of Patent: Dec. 17, 2013

(54) INFANT POSITIONING SYSTEM AND PRONE POSITIONING APPARATUS THEREFOR

(75) Inventors: Paul C. Daly, Abington, MA (US); Wyleen A. Ingram, Stoneham, MA (US); Jason P. Eaton, Hunker, PA (US)

(73) Assignee: RIC Investments, LLC, Wilmington, DE (US)

( * ) Notice: Subject to any disclaimer, the term of this patent is extended or adjusted under 35 U.S.C. 154(b) by 1032 days.

(21) Appl. No.: 12/183,139

(22) Filed: Jul. 31, 2008

(65) Prior Publication Data

US 2009/0031500 A1 Feb. 5, 2009

Related U.S. Application Data

(60) Provisional application No. 60/953,536, filed on Aug. 2, 2007.

(51) Int. Cl.
*A47C 16/00* (2006.01)

(52) U.S. Cl.
USPC ..... 5/655

(58) Field of Classification Search
USPC ..... 5/655, 655.9, 630–633, 636
See application file for complete search history.

(56) References Cited

U.S. PATENT DOCUMENTS

| | | | | | |
|---|---|---|---|---|---|
| 5,088,747 | A * | 2/1992 | Morrison et al. | ..... | 297/219.1 |
| 5,524,640 | A * | 6/1996 | Lisak et al. | ..... | 5/655 |
| 5,675,853 | A * | 10/1997 | Linge | ..... | 5/655 |
| 6,499,165 | B1 * | 12/2002 | Morgillo | ..... | 5/655 |
| 7,082,633 | B1 * | 8/2006 | Maarbjerg | ..... | 5/636 |
| 7,107,639 | B2 * | 9/2006 | Taricani | ..... | 5/655 |
| 7,117,553 | B2 * | 10/2006 | Fairchild et al. | ..... | 5/655 |
| 2008/0092300 | A1 * | 4/2008 | Joe et al. | ..... | 5/655 |

* cited by examiner

*Primary Examiner* — Peter Cuomo
*Assistant Examiner* — Nicholas Polito
(74) *Attorney, Agent, or Firm* — Timothy A. Nathan

(57) ABSTRACT

A prone positioning apparatus includes a support member for supporting an infant in a prone position. The support member has first and second ends, first and second sides having first and second opposing recesses, respectively, a top surface facing the infant, and a bottom surface. A first portion disposed at or about the first end, supports the infant's head or trunk. A second portion extends from the first portion and supports the other of the infant's head or trunk. The infant's head and trunk are, therefore, aligned and elevated with respect to at least a portion of the infant's arms and legs, in order that the infant's spine is substantially straight. The first and second recesses receive at least a portion of one of the infant's arms. A support system including at least one accessory for securing the infant in the prone position, is also disclosed.

7 Claims, 9 Drawing Sheets

INFANT POSITIONING SYSTEM AND PRONE POSITIONING APPARATUS THEREFOR

CROSS-REFERENCE TO RELATED APPLICATIONS

This application claims priority under 35 U.S.C. §119(e) from provisional U.S. patent application No. 60/953,536 filed 2 Aug. 2007, the entire contents of which are incorporated herein by reference.

BACKGROUND OF THE INVENTION

1. Field of the Invention

The invention relates generally to positioning systems and, more particularly, to prone positioning apparatus for infant positioning systems.

2. Background Information

Some infants such as, for example, babies that are born prematurely, are at risk for skeletal deformities caused by improper positioning after birth. Correct positioning results in proper skeletal development.

The prone (i.e., laying face down) position is one anatomically correct position that has been clinically proven to encourage development of flexor tone, and reduce skull flattening by providing an appropriate position on the stomach rather than on the back or side, among other benefits. When in the prone position, the shoulders of the infant should be slightly rounded and the thighs of the infant should be slightly tucked under their buttocks. In an attempt to achieve the proper prone position, nurses and other care providers for infants have typically been forced to resort to constructing a positioning device, for example, by arranging a number of rolled up towels, blankets, or pillows. These make-shift positioning devices are somewhat arbitrary in size and positioning capability and, therefore, do not provide an effective mechanism for consistently establishing the anatomically correct position of the infant. Such devices can also undesirably inhibit access to the infant, for example, by obstructing tubing or wiring that may be attached to the infant when it is in the neonatal intensive care unit (NICU).

There is, therefore, room for improvement in positioning systems and apparatus for infants.

SUMMARY OF THE INVENTION

These needs and others are met by embodiments of the invention, which are directed to an infant positioning system and prone positioning apparatus therefor, which are easily employed to consistently establish an anatomically correct prone position that promotes proper skeletal development.

As one aspect of the invention, a prone positioning apparatus is provided for an infant. The positioning apparatus comprises a support member structured to support the infant in a prone position. The support member includes first and second ends, first and second sides extending between the first and second ends and including first and second opposing recesses, respectively, a top surface structured to face the infant, and a bottom surface disposed opposite the top surface. A first portion is disposed at or about the first end of the support member, and is structured to support a corresponding one of the infant's head or trunk. A second portion extends from the first portion and is structured to support the other of the infant's head or trunk. When the support member is supporting the infant in the prone position, the infant's head and trunk are aligned and elevated with respect to at least a portion of the infant's arms and legs, in order that the infant's spine is substantially straight. Each of the first recess and the second recess is structured to receive at least a portion of a corresponding one of the infant's arms.

The first and second recesses of the support member may also be structured to position the infant's hands proximate its head, with the hands being movable to engage the head, in order to promote self-soothing. The thickness of the support member may be substantially uniform, in order that the head and trunk are supported at substantially the same elevation.

The second portion of the support member may include first and second wings extending outwardly from the top surface of the support member at or about the first and second sides, respectively, of the support member and being structured to maintain the infant's trunk in a desired position on the second portion of the support member, between the first and second wings. The first portion of the support member may include a central ridge, a first sloped surface sloping downwardly from the central ridge toward the first side of the support member, and a second sloped surface sloping downwardly from the central ridge toward the second side of the support member, such that the first and second sloped surfaces are structured to reduce the degree to which the infant's head must be turned when being supported on the first portion of the support member.

The second portion of the support member may comprise a tail extending outwardly from the second portion at or about the second end of the support member between the first and second sides of the support member, and being structured to be disposed between the infant's legs. In another embodiment, the second portion of the support member may include a first protrusion extending from the second portion toward the first end of the support member on the first side of the support member, and a second protrusion extending from the second portion toward the first end of the support member on the second side of the support member, wherein the first protrusion is disposed opposite the first recess and is structured to secure at least a portion of one of the infant's arms within the first recess, and wherein the second protrusion is disposed opposite the second recess and is structured to secure the other one of the infant's arms within the second recess.

The second portion of the support member may further include a third protrusion extending outwardly from the second end of the support member at or about the first side of the support member, and a fourth protrusion extending outwardly from the second end of the support member at or about the second side of the support member, wherein the support member is structured to secure the infant's legs between the third protrusion and the fourth protrusion. At least one of the end of the third protrusion and the end of the fourth protrusion may include an attachment mechanism structured to couple the ends of the third and fourth protrusions together in order to form a boundary structured to retain the legs of the infant. The infant's legs may push against the boundary to promote muscle development.

The support member may comprise a foam support element. A flexible membrane may substantially surround the foam support element, and a removable cover may be employed to overlay the flexible membrane.

As another aspect of the invention, a positioning system is provided. In addition to the support member of the prone positioning apparatus, the positioning system also includes at least one accessory, which is structured to cooperate with the support member in order to secure the infant in the desired prone position. The accessory or accessories may include, for example and without limitation, a generally U-shaped member structured to extend around a portion of the support member and the infant being supported thereby, an adjustable leg support structured to be coupled to the support member to support the legs of the infant, a wrap structured to be wrapped around the support member and the infant being supported thereby, or any suitable combination of the foregoing.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
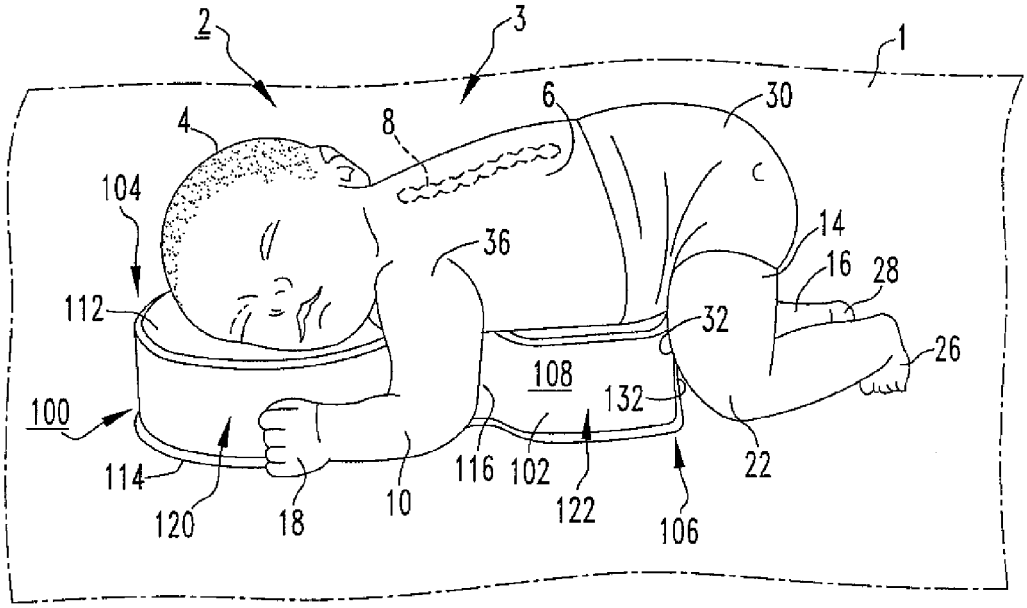
FIG. 1 is an isometric view of an infant being supported in the prone position by a prone positioning apparatus, in accordance with an embodiment of the invention.

Directional phrases used herein, such as, for example, top, bottom, left, right, upper, lower, front, back, and derivatives thereof, relate to the orientation of the elements shown in the drawings and are not limiting upon the claims unless expressly recited therein.

As employed herein, the term "prone" refers to a position of the human body in which the front of the body is turned toward the supporting surface (e.g., face down), and the thighs of the legs are at least partially bent toward the trunk of the body, for example and without limitation, so as to be tucked under the buttocks. Hence, in accordance with the invention, an infant is being supported by the disclosed prone positioning apparatus in the prone position when the infant is lying on top of the prone positioning apparatus with its body turned toward the apparatus, with at least the trunk of its body being supported by the apparatus.

As employed herein, the term "infant" is employed in accordance with its traditional meaning to refer to a child in the early stages of life, and expressly includes, but is not limited to, babies which are born prematurely, as well as full term newborn babies.

As employed herein, the term "trunk" is employed in accordance with its traditional meaning to refer to the central portion of the human body apart from the head and limbs (i.e., arms and legs).

As employed herein, the term "dysplasia" shall mean abnormal growth or development, as well as an abnormal anatomical structure (e.g., without limitation, the spine) caused by such abnormal growth or development.

As employed herein, the term "membrane" refers to any known or suitable thin flexible covering that is substantially impermeable to moisture, and expressly includes, but is not limited to, suitable flexible plastics such as, for example and without limitation, urethanes.

As employed herein, the terms "fastener" and "attachment mechanism" refer to any known or suitable securing mechanisms for securing one part to another part, and expressly include, but are not limited to, VELCRO® hook and loop fastener, buttons, zippers, belts and adhesives such as, for example and without limitation, tape.

As employed herein, the statement that two or more parts are "coupled" together shall mean that the parts are joined together either directly or joined through one or more intermediate parts.

As employed herein, the term "number" shall mean one or an integer greater than one (i.e., a plurality).

FIG. 1 shows a prone positioning apparatus 100 including a support member 102 structured to support an infant 2 in a prone position, in accordance with an example embodiment of the invention. Specifically, infant 2 has a body 3, which among other anatomical features, includes a head 4, a trunk 6, a spine 8 (shown in simplified form in hidden line drawing), arms 10,12 (both shown in FIGS. 5A, 5B, 10 and 14), and legs 14,16.

Figure 5A:
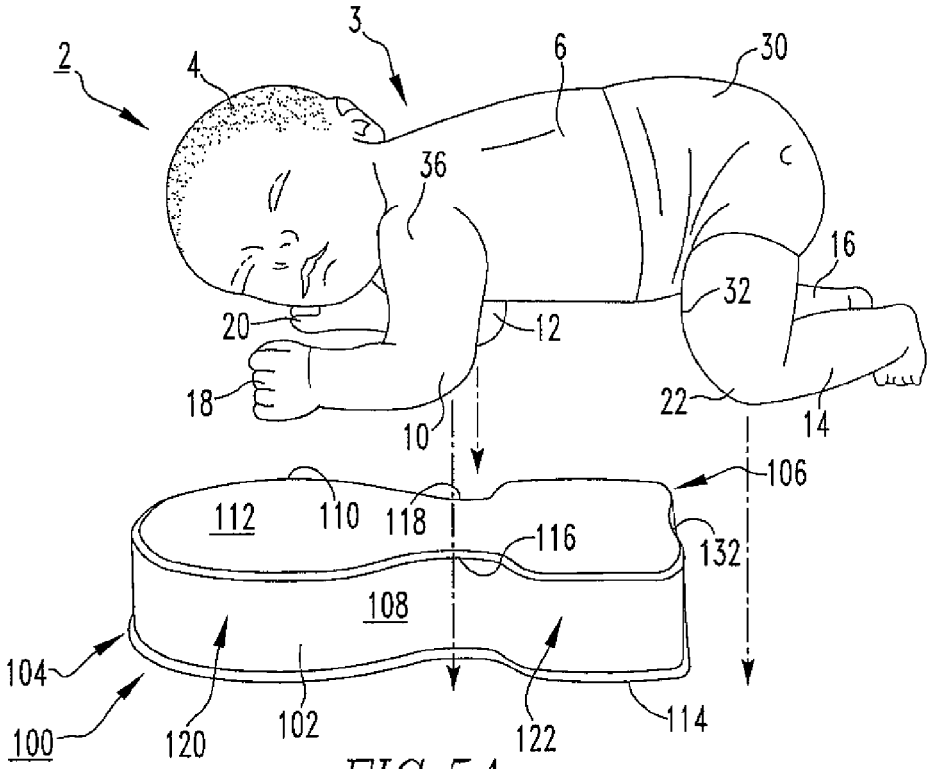
FIGS. 5A and 5B are partially exploded isometric views of the infant and prone positioning apparatus of FIG. 1 showing the prone positioning apparatus in two different orientations, respectively, in accordance with the invention.
Figure 5B:
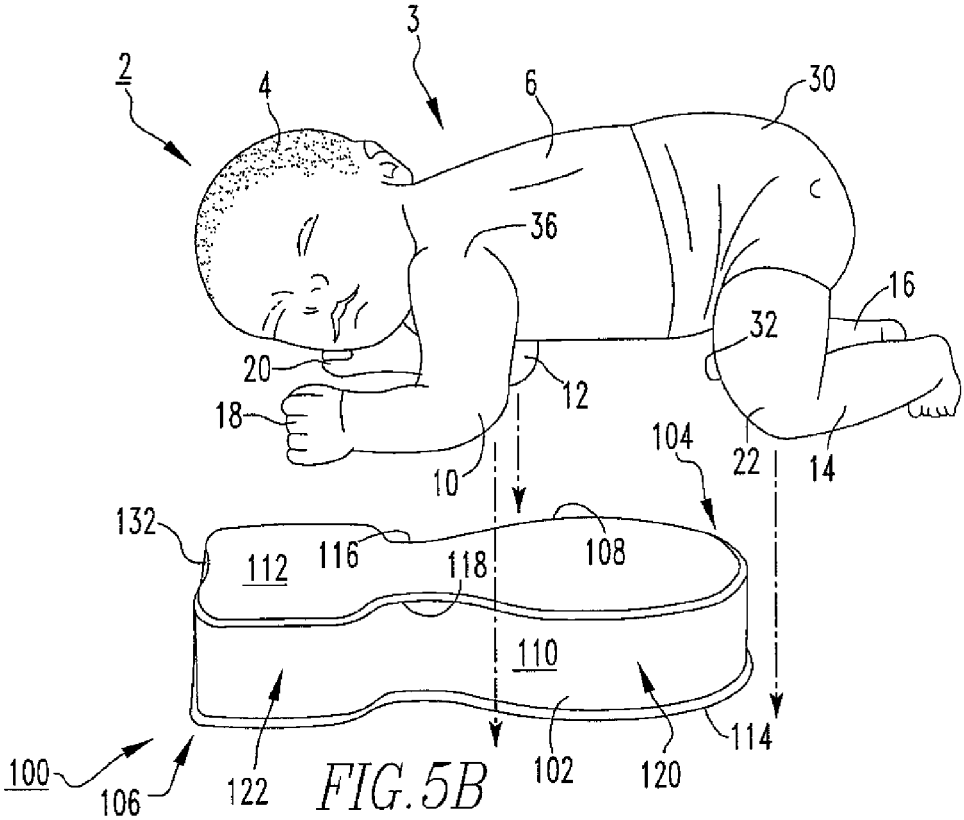

As shown in FIGS. 1-3, 5A, 5B and 6A, support member 102 includes a first end 104, a second end 106 disposed opposite and distal from the first end 104, first and second sides 108,110 (only first side 108 is shown in FIG. 1) extending between first and second ends 104,106, a top surface 112 structured to face infant 3, and a bottom surface 114 opposite top surface 112. Bottom surface 114 is structured to be disposed on a surface such as, for example and without limitation, a mattress or a surface of an incubator 1 (partially shown in phantom line drawing in FIG. 1). A first portion 120 of support member 102, which is disposed at or about first end 104 thereof, is structured to support either the infant's head 4 (FIGS. 1, 5A, 7, 9 and 10) or trunk 6 (FIG. 5B). A second portion 122, which extends from first portion 120, is structured to support the other of the infant's head 4 and trunk 6. In other words, the example support member 102 is reversible, as will be appreciated with reference to FIGS. 5A and 5B.

Figure 3:
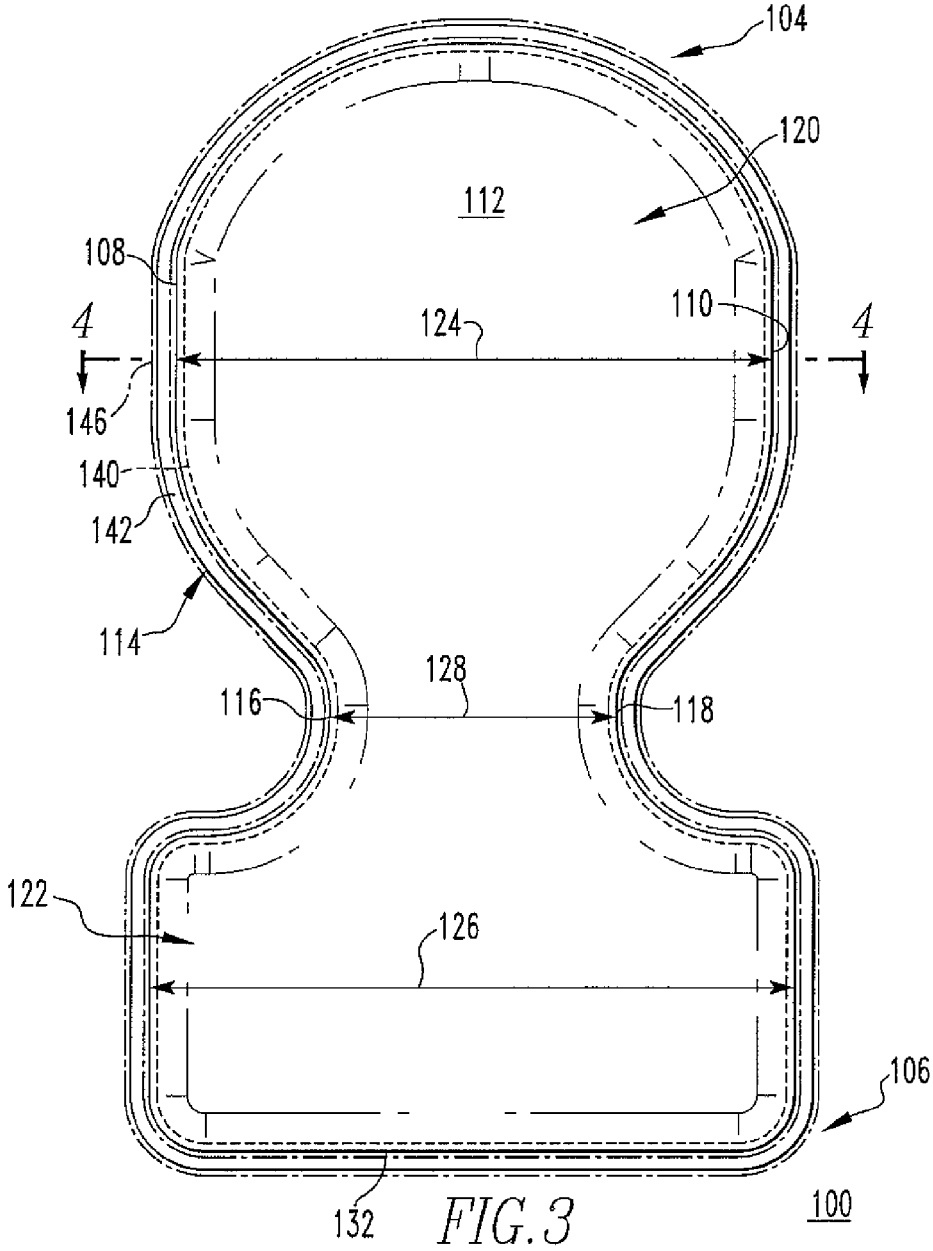
FIG. 3 is a top plan view of the prone positioning apparatus of FIG. 1.
Figure 7:
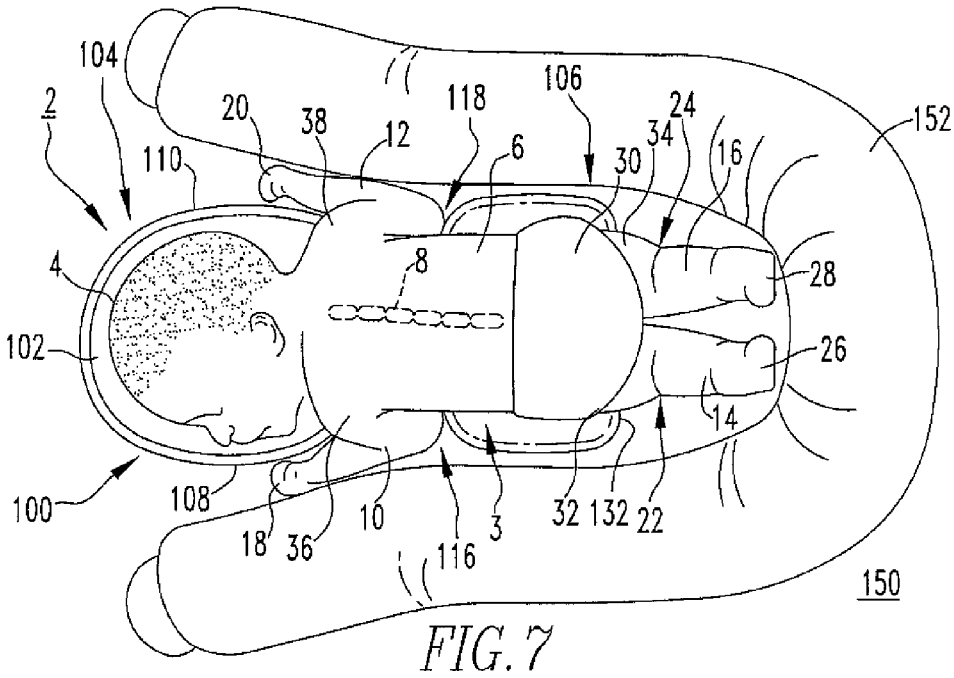
FIG. 7 is a top plan view of an infant positioning system and prone positioning apparatus therefor, shown supporting an infant in accordance with another embodiment of the invention.

First and second sides 108,110 of support member 102 include first and second recesses 116,118, respectively, which oppose one another, as best shown in FIG. 3. Each of first and second recesses 116,118 is structured to receive at least a portion of a corresponding one of arms 10,12 of infant 2, as best shown in FIG. 7. When support member 102 is supporting infant 2 in the prone position, the infant's head 4 and trunk 6 are aligned and elevated with respect to at least a portion of the infant's arms 10,12 (both shown in FIG. 7) and legs 14,16, as shown in FIG. 1, in order that the infant's spine 8 is substantially straight (see also, the top plan view of FIG. 7). It will be appreciated that recesses 116,118 are structured to position the infant's hands 18,20 proximate the infant's head 4, as shown in FIG. 7, in order that the infant may relatively easily move them to its head 4 and, in particular, to its mouth, in order to promote self-soothing. When infant 2 is comfortable and content, it is more likely to be relatively still and maintain the anatomically correct prone position that is established by support member 102.

Figure 4:
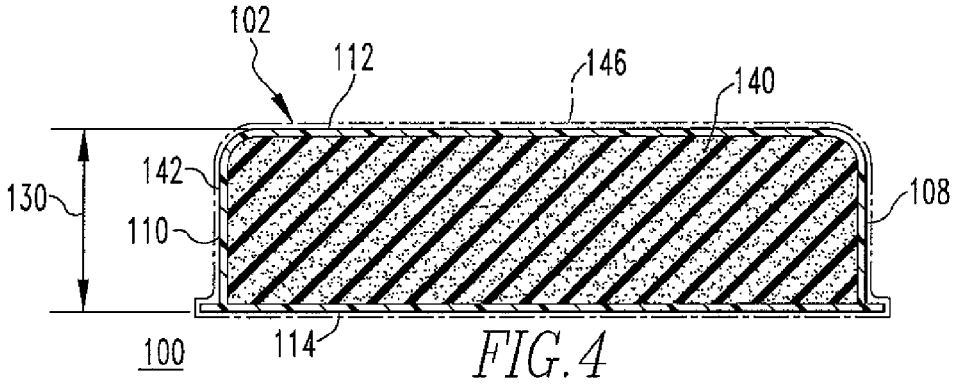
FIG. 4 is a sectional view of the prone positioning apparatus and cover therefor, of FIG. 2.

As shown in FIG. 3, first portion 120 of support member 102 has a first width 124, second portion 122 of support member 102 has a second width 126, and support member 102 has a third width 128 between first and second recesses 116,118. Third width 128 is less than first width 124 and second width 126, in order that support member 102 is generally shaped like an hourglass when viewed from a top plan perspective. This shape permits recesses 116,118 to receive the infant's arms 10,12 (see, for example, FIG. 7), as previously discussed. As shown in FIG. 4, support member 102 of prone positing apparatus 100 also has a thickness 130 between top and bottom surfaces 112,114 of support member 102. Thickness 130 is substantially uniform among first and second portions 120,122 of support member 102 as shown, for example, in FIGS. 1, 2, 5A, 5B and 6A. Uniform thickness 130 (FIG. 4) ensures that the infant's head 4 is supported at substantially the same elevation as its trunk 6, as shown, for example, in FIG. 1. Accordingly, it will be appreciated that prone positioning apparatus 100 promotes rounding of the infant's shoulders 36,38 (both shown in FIG. 7) over a raised surface, namely the corresponding portion 120,122 of support member 102. This, in combination with the legs 14,16 of the infant 2 being partially tucked up under the buttocks 30, as shown in FIGS. 1, 5A, 5B and 7, promotes the desired prone position and straight spine 8 (FIGS. 1 and 7).

More specifically, prone positioning apparatus 100 in the example of FIG. 3, includes a support member 102 having a first end 104 which is rounded such that first portion 120 of support member 102 has an oblong shape, and is substantially devoid of any abrupt corners. Second portion 122 of support member 102 has a generally rectangular shape, and second end 106 of support member 102 has a substantially straight edge 132. As shown with reference to FIG. 1, which illustrates one non-limiting example of how support member 102 may be employed to support infant 2 in the desired prone position, the infant's thighs 32 (see also thigh 34 of FIG. 6B) are engaging the substantially straight edge 132 of second end 106, in order to align the infant's knees 22 (see, also knee 24 of FIG. 6B) with the infant's shoulders 36 (both shoulders 36,38 are shown in FIG. 7). As best shown in the top plan view of FIG. 7, by positing the infant's thighs 32,34 against the substantially straight edge 132 of second end 106 of support member 102, knees 22,24 are maintained in alignment with shoulders 36,38, thereby keeping the infant's spine 8 (shown in hidden line drawing) substantially straight, as desired. It will, however, be appreciated that the desired prone position could alternatively be achieved by positing the infant 2 on support member 102 of prone positioning apparatus 100, as shown in the example of FIG. 5B, namely, such that the infant's head 4 is supported on second portion 122 of support member 102, the infant's trunk 6 is supported on first portion 120, and the thighs (only one thigh 32 is shown in FIG. 5B) are positioned against the rounded surface of first end 104 of support member 102. It will also be appreciated that prone positioning apparatus 100 and support member 102 thereof could have any known or suitable alternative configuration, as will be discussed for example and without limitation, with respect to FIGS. 11A, 11B, 12, 13 and 14, in order to support the infant 2 in the desired prone position, without departing from the scope of the invention.

Figure 11A:
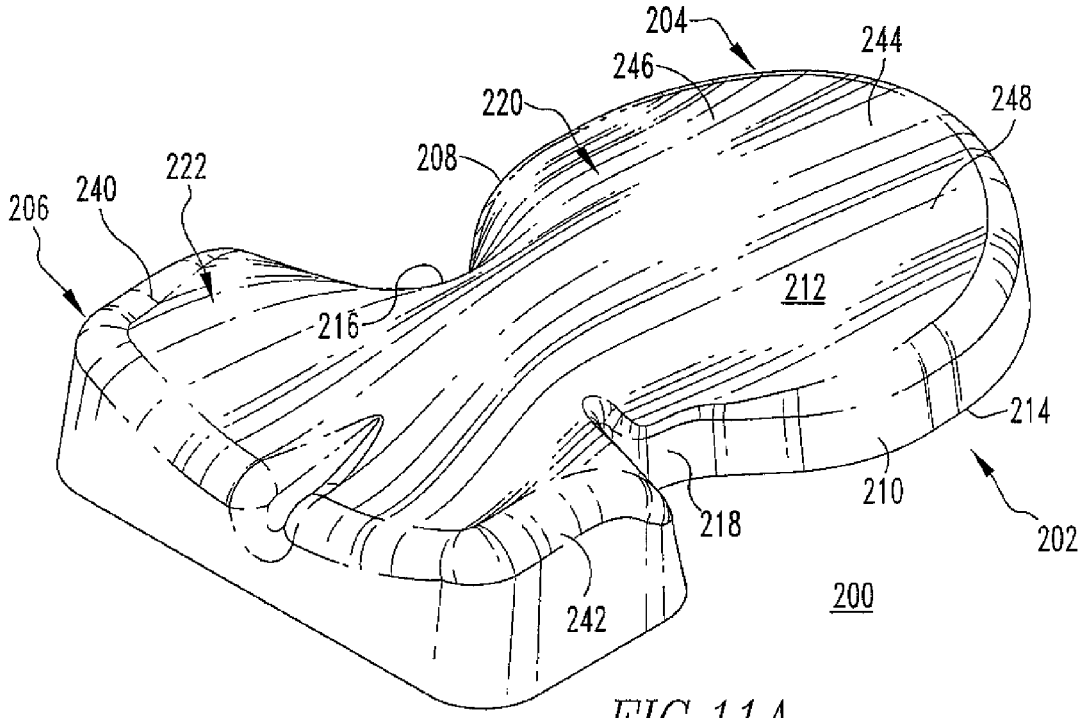
FIGS. 11A and 11B are isometric and end elevation views, respectively, of a prone positioning apparatus in accordance with another embodiment of the invention.
Figure 11B:
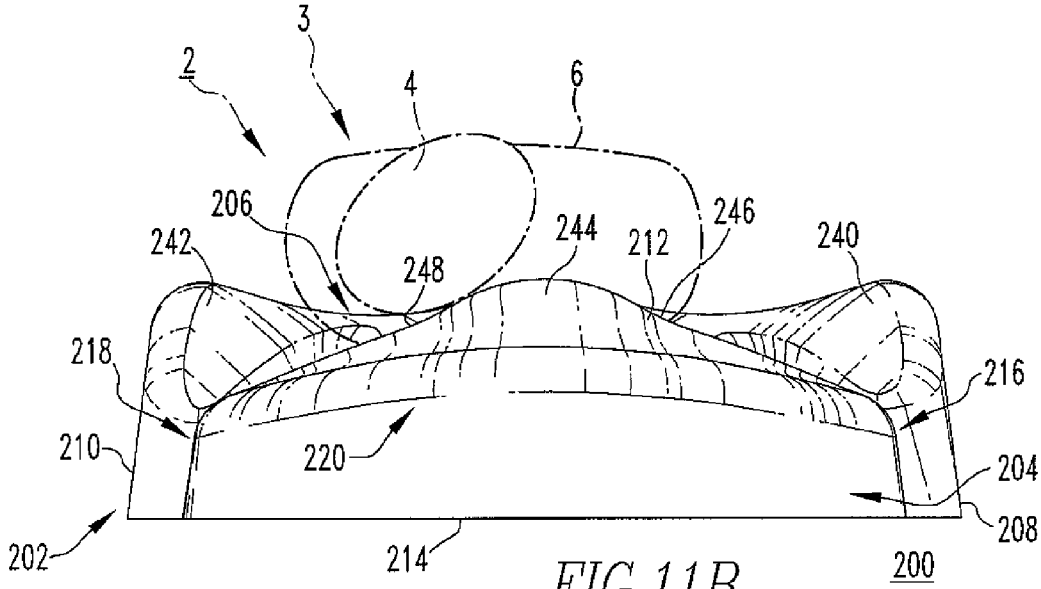
Figure 12:
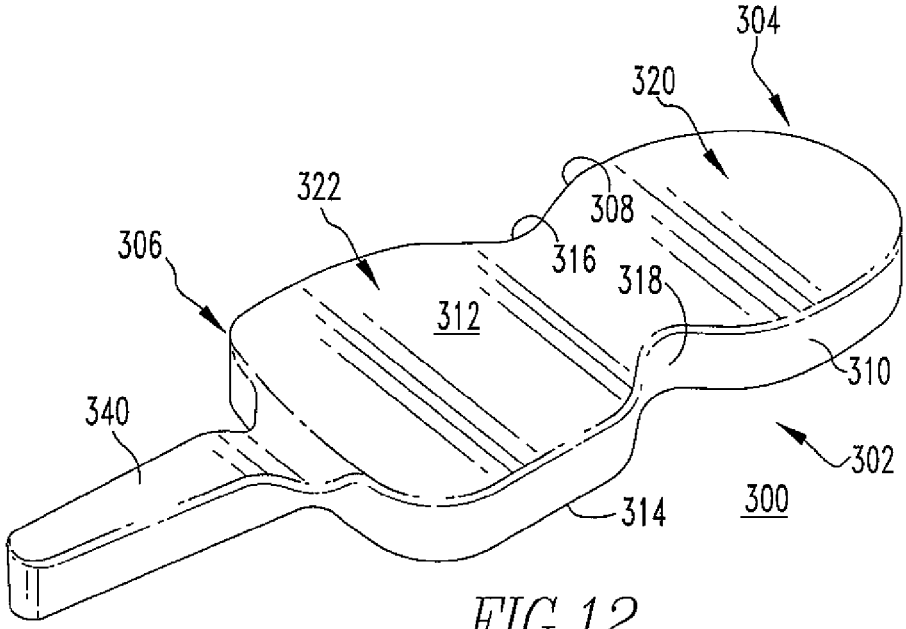
FIG. 12 is an isometric view of a prone positioning apparatus in accordance with another embodiment of the invention.
Figure 13:
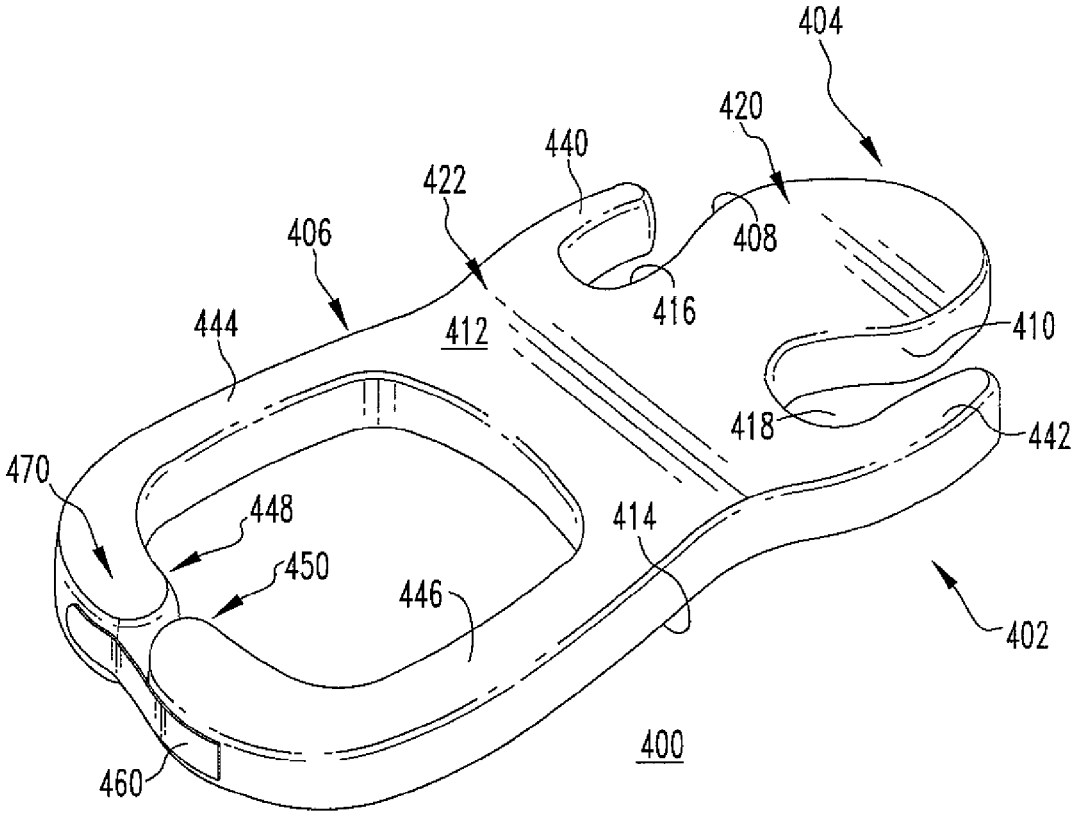
FIG. 13 is an isometric view of a prone positioning apparatus in accordance with another embodiment of the invention.
Figure 14:
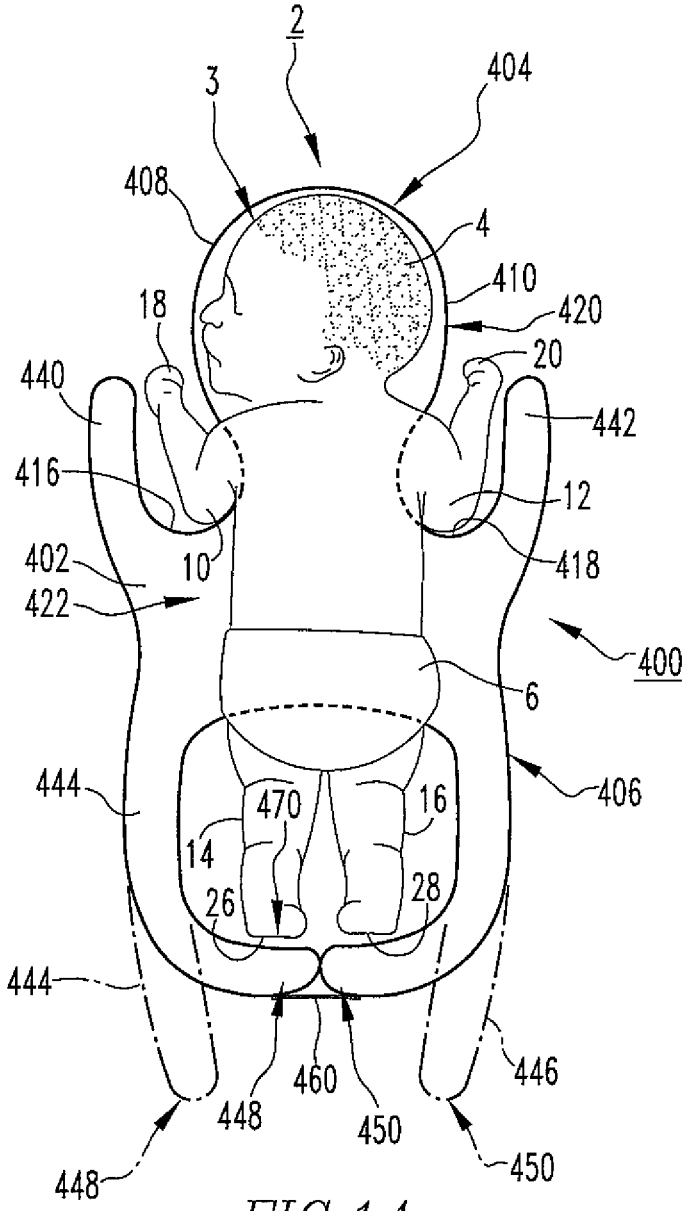
FIG. 14 is a top plan view of the prone positioning apparatus of FIG. 13, shown supporting an infant.

It will also be appreciated that prone positioning apparatus 100 (see also, for example and without limitation, prone positioning apparatus 200 of FIGS. 11A and 11B, prone positioning apparatus 300 of FIG. 12, and prone positioning apparatus 400 of FIGS. 13 and 14) and, in particular, support member 102 (see also, for example and without limitation, support member 202 of FIGS. 11A and 11B, support member 302 of FIG. 12, and support member 402 of FIGS. 13A and 13B) thereof, can be made from any known or suitable material or a combination of materials. For example and without limitation, as shown in the sectional view of FIG. 4, support member 102 of the example prone positioning apparatus 100 includes a foam support element 140, which can be made from any known or suitable foam material such as, for example and without limitation, visco elastic foam, which is commonly referred to in the art as "memory foam." It could, however, be made from any other known or suitable resilient cushioning materials such as, for example and without limitation, gels. The example foam support element 140 may be die cut or otherwise suitably formed to have the desired shape such as, for example and without limitation, the generally hourglass-shaped support member 102, shown in the example of FIG. 3. The example foam support element 140 is one single piece of material, although it will be appreciated that it could alternatively be comprised of multiple pieces joined together.

The example support member 102 also includes a flexible membrane 142, which substantially surrounds foam support element 140. Membrane 142 preferably includes at least one air hole 144 (FIG. 2) structured to allow air to enter and exit flexible membrane 142, in order to allow foam support element 140 (hidden in FIG. 2) to compress and decompress, respectively, to comfortably support the infant's body 3, as desired. Flexible membrane 142 may comprise any known or suitable material, which is preferably substantially impermeable to moisture. In this manner, flexible membrane 142 will be relatively easy to wipe clean, and will also function to prevent the undesired entry of moisture into internal foam support element 140. In one, non-limiting example, flexible membrane 142 may comprise a thin and thus flexible plastic material such as, for example and without limitation, urethane. Flexible membrane 142 may be applied to foam support element 140 by vacuum forming or by any other known or suitable process or method.

Figure 2:
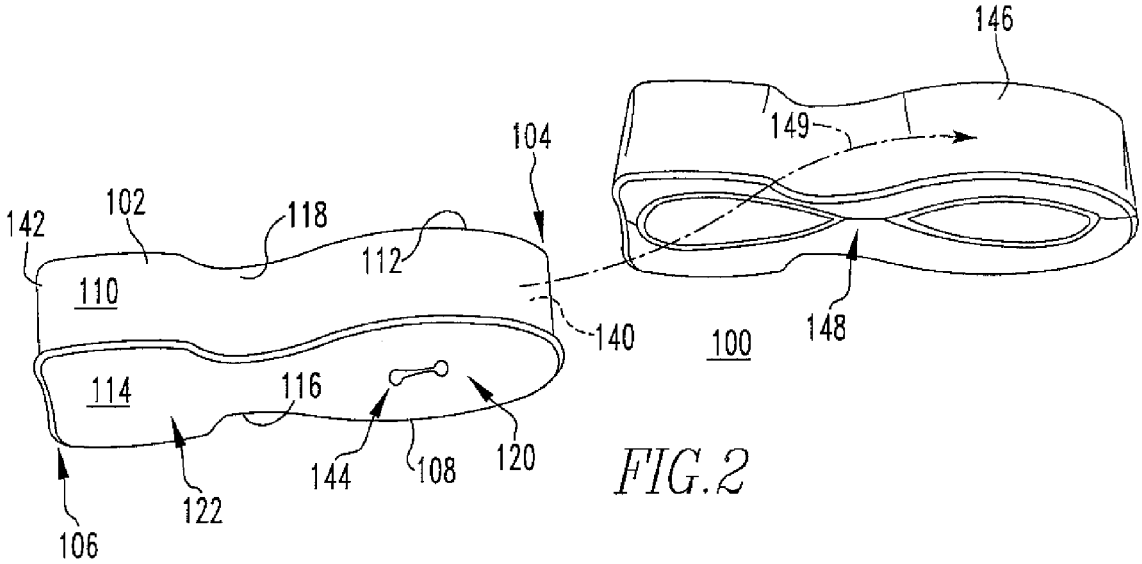
FIG. 2 is a partially exploded isometric view of the prone positioning apparatus of FIG. 1 and a cover therefor, in accordance with an embodiment of the invention.

Continuing to refer to FIGS. 2 and 4, support member 102 may further include a removable cover 146, which is structured to overlay flexible membrane 142, in order to be disposed between flexible membrane 140 and infant 2 (FIG. 1). Cover 146 may be made from any known or suitable material such as, for example and without limitation, cotton or another suitable fabric, which is preferably soft to provide added comfort for the infant 2 (FIG. 1). Cover 146 is preferably removable and washable. It may also include a securing mechanism or portion such as, for example and without limitation, stitching 148 on the bottom of cover 146, shown in FIG. 2. It will be appreciated that support member 102 of prone positioning apparatus 100 of the example of FIG. 2, is inserted into cover 146 in the manner generally indicated by arrow 149. It will also be appreciated that the components (e.g., without limitation, foam support element 140; flexible membrane 142; cover 146) can be made from any known or suitable alternative material(s) other than those which are shown and described herein, without departing from the scope of the invention. It will further be appreciated that not all of the components are required. For example and without limitation, it is within the scope of the invention to employ only the aforementioned foam support element 140, without one or both of flexible membrane 142 and/or cover 146. Also, prone positioning apparatus 100 may be made in a variety of different sizes to accommodate different size infants 2. All of the materials used in support member 102 are preferably antimicrobial, in order to resist the undesirable retention of germs.

It will also be appreciated that prone positioning apparatus 100 and, for that matter, prone positioning apparatus 200,300 and 400, shown respectively in FIGS. 11A and 11B, 12, and 13 and 14, may be employed as part of a positioning system 50 (FIGS. 6A and 6B), 150 (FIGS. 7 and 10), 250 (FIGS. 8-10) that also includes at least one accessory 52 (FIGS. 6A and 6B), 152 (FIGS. 7 and 10), 252 (FIGS. 8-10), which is structured to cooperate with support member 102 of the corresponding prone positioning apparatus 100, in order to further secure the infant 2 (FIGS. 1, 5A, 5B, 6B, 7, 9, 10, 11B, and 14).

Figure 6A:
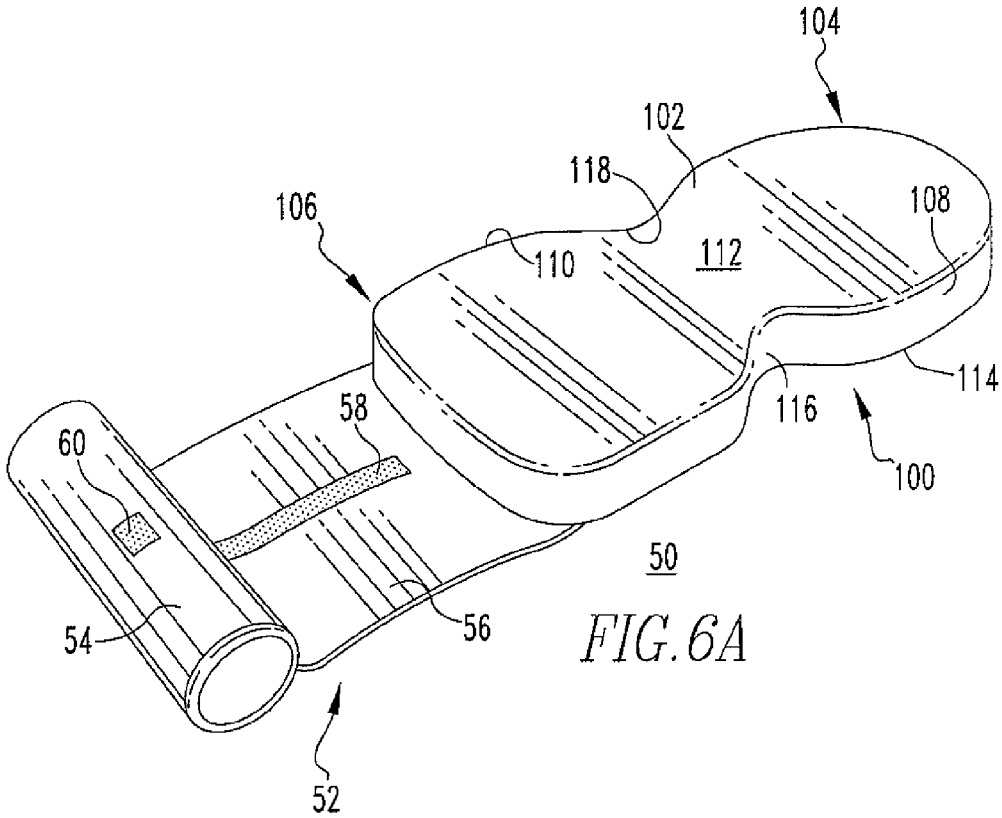
FIGS. 6A and 6B are isometric and side elevation views, respectively, of an infant positioning system and prone positioning apparatus therefor, in accordance with another embodiment of the invention.
Figure 6B:
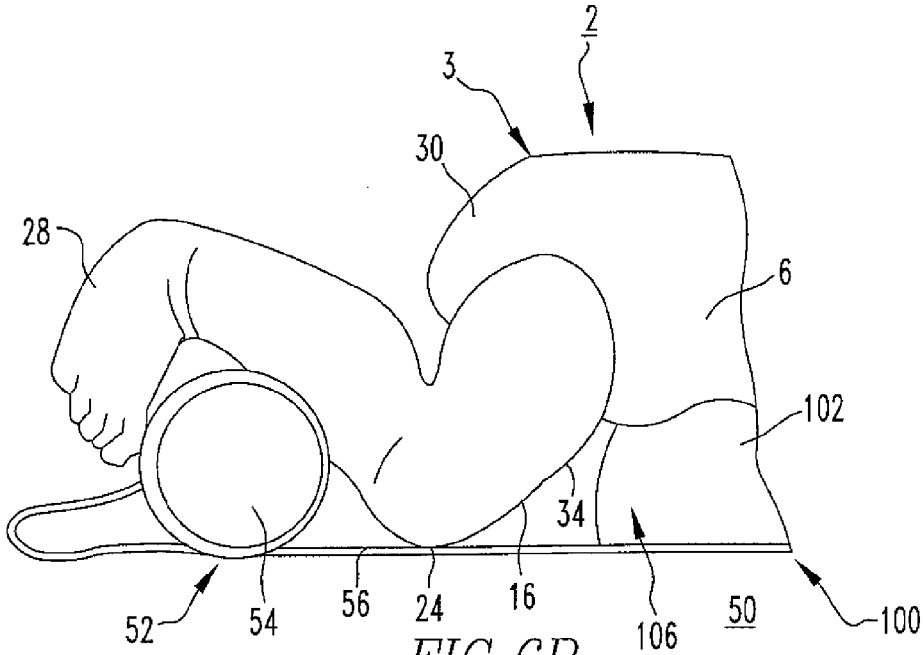

For example, as shown in FIGS. 6A and 6B, positioning system 50 may include an adjustable leg support 52, which is structured to be coupled to support member 102, to support the infant's legs 14,16 (only leg 16 is shown in FIG. 6B). More specifically, the example adjustable leg support 52 includes a cylindrical member 54 and an attachment element 56 extending outwardly from cylindrical member 54 and being structured to be coupled to a corresponding one of first and second ends 104,106 of support member 102. Attachment element 56 may include, for example and without limitation, a piece of fabric extending between cylindrical member 54 and support member 52, as shown. Cylindrical member 54 may be made from any known or suitable material or combination of materials. For instance, in one non-limiting example, cylindrical member 54 may comprise a fabric casing filled with a suitable cushioning material such as, for example and without limitation, foam or polyfill. The example adjustable leg support 52 is removably coupled to second end 106 of support member 102, although it will be appreciated that it could alternatively be permanently attached to one or the other of first and second ends 104,106. As shown in FIG. 6B, cylindrical member 54 is adjustable to any desired position in which it supports legs 14,16 (one leg 16 is shown) between knees 22,24 (one knee 24 is shown) and feet 26,28 (one foot 28 is shown), as desired. Adjustable leg support 52 may additionally optionally include an attachment mechanism for securing it in the desired position. For example and without limitation, as shown in FIG. 6A, the example adjustable leg support 52 includes an elongated VELCRO® hook and loop fastener strip 58 disposed on attachment element 56, and a corresponding VELCRO® hook and loop fastener tab 60 disposed on cylindrical member 54. Tab 60 is structured to engage and be secured by VELCRO® hook and loop fastener strip 58, in order to secure cylindrical member 54 in the desired position. It will, however, be appreciated that any known or suitable alternative attachment mechanism other than the example VELCRO® hook and loop fastener, could be employed in any suitable configuration.

FIG. 7 shows an example positioning system 150 which employs an elongated member 152, which is structured to extend around a portion of support member 102 and infant 2 being supported thereby. In the example shown, elongated member 152 is generally U-shaped, although it will be appreciated that other shapes and configurations are also contemplated by the invention. For example and without limitation, a member (not shown) that extends the entire way around support member 102 and infant 2, so as to encircle prone positioning apparatus 100, could be employed. As with the aforementioned cylindrical member 54 of adjustable leg support 52, discussed with respect to FIGS. 6A and 6B, elongated member 152 may be made from any known or suitable material or combination of materials. Among other advantages, members such as the example generally U-shaped member 152, which extend around a portion of infant 2, provide a boundary against which infant 2 may push, for example with its feet 26,28 and/or arms 10,12, in order to promote muscle development. This aspect of the invention will be further discussed herein below with respect to prone positioning apparatus 400 of FIGS. 13 and 14.

Figure 8:
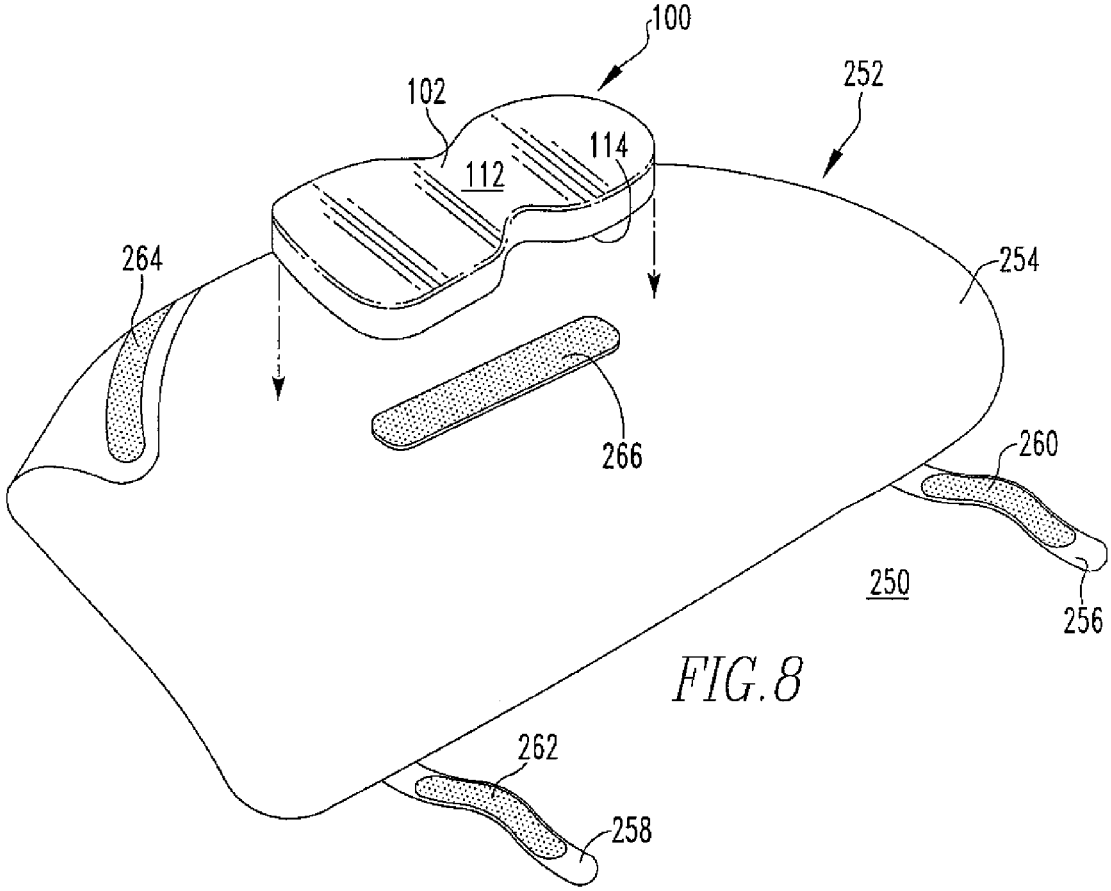
FIG. 8 is an isometric view of an infant positioning system and prone positioning apparatus therefor, in accordance with another embodiment of the invention.
Figure 9:
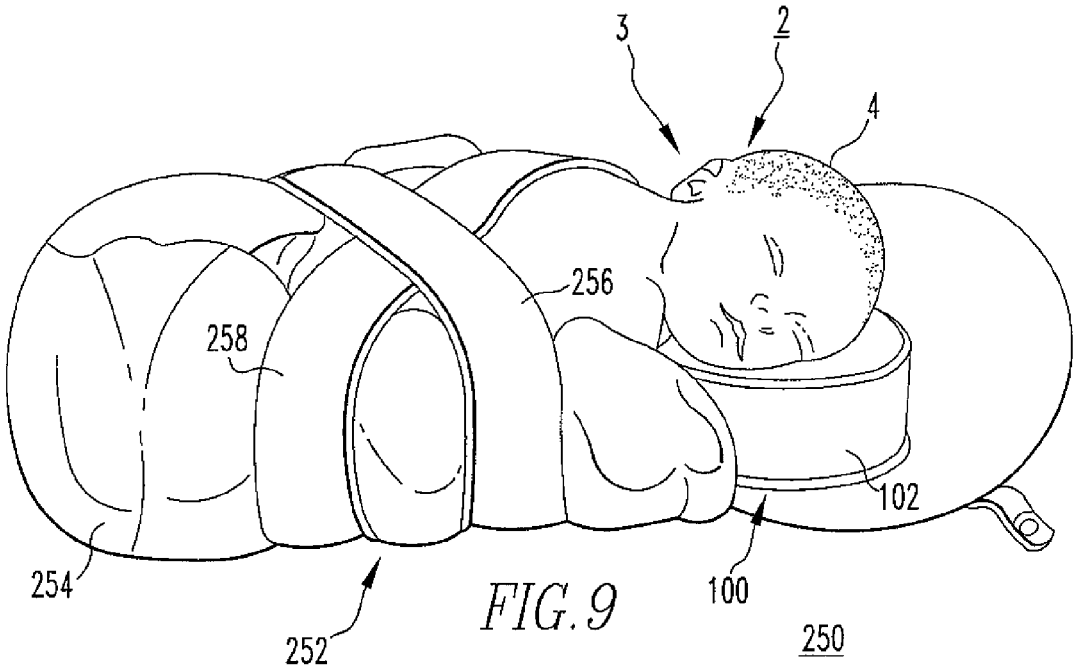
FIG. 9 is an isometric view of the positioning system and prone positioning apparatus therefor of FIG. 8, shown securing an infant.

FIGS. 8 and 9 show another example positioning system 250, which in addition to prone positioning apparatus 100, includes a wrap 252 that is structured to be wrapped around support member 102 of prone positioning apparatus 100 and infant 2 (FIG. 9) being supported thereby. The example wrap 252 includes a coverlet 254 (e.g., without limitation, blanket) and a number of straps 256,258 (two are shown), which extend outwardly from an edge of coverlet 254. Support member 102 is disposed on coverlet 254, at which point infant 2 is placed in the prone position on support member 102 and coverlet 254 is wrapped around support member 102 and infant 2. Straps 256,258 are then wrapped around support member 102 and infant 2, in order to secure coverlet 254 and, thus, infant 2, in the desired position. It will be appreciated that any known or suitable attachment mechanism may be employed to fasten straps 256,258, in order to maintain the position of coverlet 254 with respect to infant 2 and support member 102. For example and without limitation, as shown in FIG. 8, the example wrap 252 includes an elongated strip of VELCRO® hook and loop fastener 264 extending along one edge of coverlet 254 opposite edge having the straps 256,258, and corresponding VELCRO® hook and loop fastener strips 260,262 disposed on straps 256,258, respectively, as shown in FIG. 8. Thus, when straps 256,258 are wrapped around coverlet 254, infant 2, and support member 102, the VELCRO® hook and loop fastener strips 260,262 engage, and are secured by, elongated VELCRO® hook and loop fastener strip 264. The example wrap 252 also includes an additional VELCRO® hook and loop fastener strip 266 at the location on coverlet 254 where support member 102 of prone positioning apparatus 100 is to be disposed. A corresponding VELCRO® hook and loop fastener strip (not shown) can be included on bottom surface 114 of support member 102, in order to ensure that support member 102 is maintained in the desired position with respect to coverlet 254. It will be appreciated that any known or suitable alternative number and/or configuration of straps (e.g., without limitation, 256,258) or other suitable attachment mechanism(s) could be employed without departing from the scope of the invention. It will also be appreciated that a combination of the aforementioned adjustable leg support 52 (FIGS. 6A and 6B), U-shaped member 152 (FIG. 7), and wrap 252 (FIGS. 8 and 9) accessories could be employed in any suitable combination.

Figure 10:
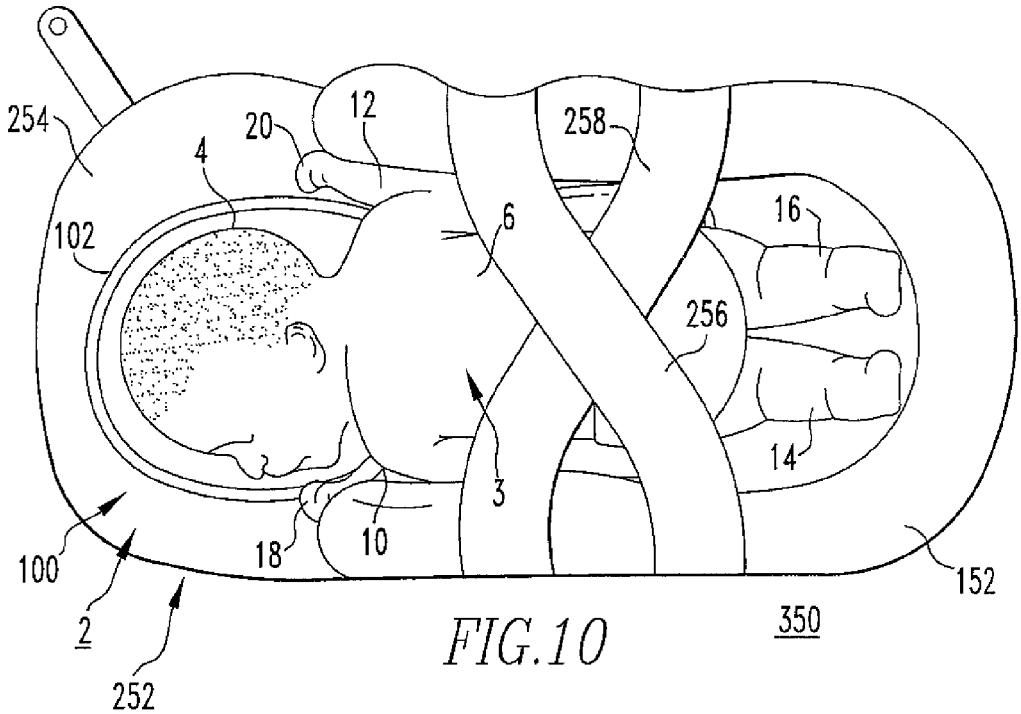
FIG. 10 is a top plan view of the positioning system and prone positioning apparatus therefor of FIG. 7, shown securing an infant.

For example and without limitation, FIG. 10 shows a positioning system 350, which comprises a combination of the aforementioned U-shaped member 152 and wrap 252 accessories, along with prone positioning apparatus 100. FIG. 10 illustrates merely one of the many different possible combinations of accessories 52,152,252 and prone positioning apparatus 100,200,300,400, in accordance with the invention. In the embodiment of FIG. 10, positioning system 350 provides both the boundary created by generally U-shaped member 152, against which infant 2 may push in order to promote muscle development, and the additional security provided by straps 256,258 of wrap 252, which surround infant 2. It will also be noted that, as shown in FIG. 10, coverlet 254 of wrap 252 is not required to wrap entirely around support member 102 and infant 2 supported thereby. Rather, merely straps 256,258 can do so, as shown. In this manner, access to infant 2, for example, in order to attach or provide access for tubes, wires, sensors or other baby monitoring equipment (e.g., without limitation, a pulse oximeter; a blood pressure cuff), is maintained.

FIGS. 11A and 11B show an example prone positioning apparatus 200, which is contoured in accordance with the invention. More specifically, support member 202 of prone positioning apparatus 200 includes a first wing 240 extending outwardly from top surface 212 of support member 202 at or about the first side of the support member 208, and a second wing 242 extending outwardly from top surface 212 of support member 202 at our about second side 210 of support member 202. The example wings 240,242 are blended (e.g., form a smooth transition) with respect to the remainder of second portion 222 of support member 202, in order to conform to the shape of the infant's body 3 (shown in simplified form in phantom line drawing in FIG. 11B). Specifically, first and second wings 240,242 are structured to maintain the trunk 6 of infant 2 in a desired position on second portion 222 of support member 202, between first and second wings 240, 242, as shown in simplified form in phantom line drawing in FIG. 11B. First portion 220 of contoured support member 202 of the example prone positioning apparatus 200 includes a central ridge 244, a first sloped surface 246 sloping downwardly from central ridge 244 toward first side 208 of support member 202, and a second sloped surface 248 sloping downwardly from central ridge 244 toward second side 210 of support member 202, as best shown in FIG. 11B. Sloped surfaces 246,248 are structured to reduce the degree to which the infant's head 4 (shown in simplified form in phantom line drawing in FIG. 11B) must be turned when being supported on first portion 220 of support member 202. In this manner, contoured support member 202 and, in particular, wings 240, 242 and sloped surfaces 246,248 thereof, are structured to increase the level of comfort of the infant 2. Accordingly, as previously discussed, the infant 2 should be comfortable and content and, thus, more likely to remain calm and relatively still in the desired anatomically correct prone position.

FIG. 12 shows another example prone positioning apparatus 300, in accordance with another embodiment of the invention, wherein support member 302 is substantially similar to support member 102 of prone positioning apparatus 100, previously discussed with respect to FIGS. 1-10, but further includes a tail 340. Specifically, support member 302 includes a first end 304, a second end 306, first and second opposing sides 308,310, a top surface 312, a bottom surface 314 disposed opposite top surface 312, and first and second opposing recesses 316,318. Tail 340 extends outwardly from second portion 322 at or about second end 306 of support member 302, between first and second sides 308,310 of support member 302. Accordingly, it will be appreciated that tail 340 is structured to be disposed between the infant's legs 14,16 (not shown in FIG. 12).

FIGS. 13 and 14 show another example prone positioning apparatus 400 including a support member 402 that has a first end 404, a second end 406, first and second opposing sides 408,410, a top surface 412, and a bottom surface 414. A first portion 420 of support member 402 is structured to support the head 4 of the infant's body 3, as shown in FIG. 14, and a second portion 422 is structured to support the infant's trunk 6. Second portion 422 includes a first protrusion 440, which extends from second portion 422 toward first end 404 of support member 402 on first side 408 of support member 402, and a second protrusion 442 extending toward first end 404 and being disposed on second side 410 of support member 402. Thus, first protrusion 440 is disposed opposite first recess 416, and is structured to secure at least a portion of one of the infant's arms 10 within first recess 416, as shown in FIG. 14. Second protrusion 442 similarly is disposed opposite second recess 418 in order to secure at least a portion of the other one of the infant's arms 12 within second recess 418. Second portion 422 also includes a third protrusion 444 extending outwardly from second end 406 of support member 402 at or about first side 408 thereof, and a fourth protrusion 446 extending outwardly from second end 406 of support member 402 at our about second side 410 thereof. Third and fourth protrusions 444,446 are structured to secure the infant's legs 14,16 therebetween, as shown in FIG. 14.

Each of third and fourth protrusions 444,446 includes an end 448,450, respectively, which is disposed distal from second end 406 of support member 402. At least one of end 448 of third protrusion 444, and end 450 of fourth protrusion 446 includes a suitable attachment mechanism 460 (e.g., without limitation, tape; VELCRO® hook and loop fastener), which is structured to couple ends 448,450 together, as shown in FIG. 13. Accordingly, when end 448 of third protrusion 444 is coupled to end 450 of fourth protrusion 446, as shown in solid line drawing in FIG. 14, third and fourth protrusions 444,446 form a boundary 470 structured to retain the legs 14,16 of infant 2. As previously discussed, such boundary 470 is structured to be engageable by the infant's legs 14,16 and, in particular, to be pushed against by the infant's feet 26,28, in order to promote muscle development. Third and fourth protrusions 444,446 are shown in their respective substantially straight positions, corresponding to ends 448,450 thereof not being coupled together, in phantom line drawing in FIG. 14.

Accordingly, the disclosed infant prone positioning apparatus elevates the head and trunk of the infant in a manner that promotes the shoulders being properly rounded and the legs being partially tucked under the buttocks and aligned with the shoulders to establish an anatomically correct prone position in which the spine is substantially straight. The disclosed positioning system provides a number of accessories for use with the prone positioning apparatus in order to, for example, farther secure the infant in the desired position and to foster muscle development. In view of the foregoing, dysplasia is resisted and proper skeletal development is promoted.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A prone positioning apparatus for an infant, such infant having a body including a head, a trunk, a spine, arms and legs, the prone positioning apparatus comprising:

a support member structured to support such infant in a prone position, the support member including a first end, a second end disposed opposite and distal from the first end, a first side extending between the first end and the second end and including a first recess, a second side disposed opposite the first side and including a second recess disposed opposite the first recess, a top surface structured to face such infant, and a bottom surface opposite the top surface;

a first portion disposed at or about the first end of the support member and being structured to support a corresponding one of the head of such infant and the trunk of such infant; and a second portion extending from the first portion and being structured to support the other of the corresponding one of the trunk of such infant and the head of such infant, wherein the first portion of the support member has a first width; wherein the second portion of the support member has a second width; wherein the support member has a third width between the first recess and the second recess; and wherein the third width is less than the first width and the second width, wherein, when the support member is supporting such infant in the prone position, the head of such infant and the trunk of such infant are aligned and elevated with respect to at least a portion of the arms and at least a portion of the legs of such infant, in order that the spine of such infant is substantially straight, wherein each of the first recess and the second recess is structured to receive at least a portion of a corresponding one of the arms of such infant, wherein the second portion of the support member comprises a first protrusion extending from the second portion toward the first end of the support member on the first side of the support member, and a second protrusion extending from the second portion toward the first end of the support member on the second side of the support member;

wherein the first protrusion is disposed opposite the first recess, and is structured to secure at least a portion of the corresponding one of the arms of such infant within the first recess; and wherein the second protrusion is disposed opposite the second recess, and is structured to secure at least a portion of the other of the corresponding one of the arms of such infant within the second recess.

2. The prone positioning apparatus of claim 1 wherein the second portion of the support member further comprises a third protrusion extending outwardly from the second end of the support member at or about the first side of the support member, and a fourth protrusion extending outwardly from the second end of the support member at or about the second side of the support member; and wherein the support member is structured to secure the legs of such infant between the third protrusion and the fourth protrusion.

3. The prone positioning apparatus of claim 2 wherein each of the third protrusion and the fourth protrusion include an end disposed distal from the second end of the support member; wherein at least one of the end of the third protrusion and the end of the fourth protrusion includes an attachment mechanism; wherein the attachment mechanism is structured to couple the end of the third protrusion and the end of the fourth protrusion together; wherein, when the end of the third protrusion and the end of the fourth protrusion are coupled together by the attachment mechanism, the third protrusion and the fourth protrusion form a boundary structured to retain the legs of such infant; and wherein the boundary is structured to be engageable by the legs of such infant, in order for such infant to push against the boundary to promote muscle development.

4. A positioning system for an infant, such infant having a body including a head, a trunk, a spine, arms and legs, the positioning system comprising:

a prone positioning apparatus comprising a support member structured to support such infant in a prone position, the support member including a first end, a second end disposed opposite and distal from the first end, a first side extending between the first end and the second end and including a first recess, a second side disposed opposite the first side and including a second recess disposed opposite the first recess, a top surface structured to face such infant, and a bottom surface opposite the top surface;

a first portion disposed at or about the first end of the support member and being structured to support a corresponding one of the head of such infant and the trunk of such infant;

a second portion extending from the first portion and being structured to support the other of the corresponding one of the trunk of such infant and the head of such infant; and at least one accessory being structured to cooperate with the support member in order to secure such infant in the prone position, wherein, when the support member is supporting such infant in the prone position, the head of such infant and the trunk of such infant are aligned and elevated with respect to at least a portion of the arms and at least a portion of the legs of such infant, in order that the spine of such infant is substantially straight, wherein each of the first recess and the second recess is structured to receive at least a portion of a corresponding one of the arms of such infant, and wherein the at least one accessory is a generally U-shaped elongated member structured to extend around a portion of the support member and such infant being supported by the support member, the U-shaped elongated member being separate and unattached from the support member.

5. The positioning system of claim 4 wherein the at least one accessory includes is a wrap structured to be wrapped around the support member and such infant being supported by the support member.

6. The positioning system of claim 5 wherein the wrap comprises a coverlet and a number of straps extending outwardly from the coverlet; wherein the support member is disposed on the coverlet; wherein the coverlet is structured to be wrapped around the support member and such infant being supported by the support member; and wherein the number of straps are structured to wrap around at least a portion of such infant and the support member, and to be fastened, in order to maintain the position of the coverlet with respect to such infant and the support member.

7. The positioning system of claim 4 further comprising an adjustable leg support structured to be coupled to the support member to support the legs of such infant, and a wrap structured to be wrapped around the support member and such infant being supported by the support member.

* * * * *